US006275160B1

(12) United States Patent
Ha

(10) Patent No.: US 6,275,160 B1
(45) **Date of Patent: *Aug. 14, 2001**

(54) MULTI-MODE WATERFLOW DETECTOR WITH ELECTRONIC TIMER

(75) Inventor: Simon Ha, Aurora, IL (US)

(73) Assignee: Pittway Corporation, Chicago, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/532,913

(22) Filed: Mar. 22, 2000

Related U.S. Application Data

(63) Continuation-in-part of application No. 09/059,475, filed on Apr. 13, 1998.

(51) Int. Cl.[7] ..... G08B 21/00

(52) U.S. Cl. ..... 340/606; 340/609; 340/618; 340/644; 200/182; 200/186; 200/187; 200/190

(58) Field of Search ..... 340/606, 609, 340/615, 618, 506, 644; 73/861.77, 861.78; 200/181, 182, 186, 187, 190

(56) References Cited

U.S. PATENT DOCUMENTS

| | | | | |
|---|---|---|---|---|
| 3,921,989 | | 11/1975 | Ward . | |
| 4,958,144 | | 9/1990 | Griess . | |
| 5,240,022 | | 8/1993 | Franklin . | |
| 5,315,294 | | 5/1994 | Toth . | |
| 5,446,449 | | 8/1995 | Lhomer et al. . | |
| 5,614,067 | * | 3/1997 | Okazaki | 204/228.3 |
| 5,659,300 | | 8/1997 | Dresselhuys . | |
| 5,669,405 | | 9/1997 | Engelmann . | |
| 5,680,329 | | 10/1997 | Lloyd et al. . | |
| 5,705,987 | | 1/1998 | Doner . | |
| 5,783,155 | * | 7/1998 | Greenler | 422/102 |
| 5,822,819 | * | 10/1998 | Ferragut | 8/158 |

* cited by examiner

*Primary Examiner*—Jeffery Hofsass
*Assistant Examiner*—Davetta W. Goins

(57) ABSTRACT

A flow detector includes solid state delay circuitry coupled to a flow indicating device. In response to flow being indicated, the delay circuitry is enabled. After a preset delay interval, if flow is still being indicated, an output signal can be generated. The flow indicating device can be a two-state mechanical switch. A mode setting element can be used to configure the detector for different types of installations.

56 Claims, 6 Drawing Sheets

60
66
TIMING SELECT
TIMING LOGIC
SET RELAY DRIVER
TIMER ENABLE
TIMER CIRCUIT BLOCK
66 - 1
ONE SHOT GENERATOR
RESET RELAY DRIVER
66 - 2
NO FLOW RELAY RESET CIRCUIT BLOCK
Vdd
NO FLOW RESET
NO FLOW N.C.
FLOW
64
FLOW SWITCH
64a
CIRCUIT GROUND
62 - 1
62 - 2
POWER SUPPLY
62
TIMING DELAY "D"
t
SET
FLOW
66a
66b
SET SIGNAL
RESET SIGNAL
68a
68b
68
COM
LATCH RELAY
N.C.
N.O.
70 - 1
70 - 2
FLOW SWITCH, 64b
INTELLIGENT/ CONVENTIONAL PANEL SWITCH, 70
T1
T2
C1
C2

MULTI-MODE WATERFLOW DETECTOR WITH ELECTRONIC TIMER

This is a continuation-in-part of U.S. Ser. No. 09/059,475 entitled "Waterflow Detector With Electronic Timer" filed Apr. 13, 1998.

FIELD OF THE INVENTION

The invention pertains to electronic timers used to help suppress transient signals. More particularly, the invention pertains to such timers used in waterflow detectors.

BACKGROUND OF THE INVENTION

Fire alarm systems have used a variety of technologies to attempt to provide audible or visible warnings of the existence of a fire condition to individuals in an area being monitored. In one known type of system, ambient condition detectors such as smoke, flame or thermal detectors are distributed in an area to be monitored. These units are often coupled via a communication link to a common control console or control panel.

The panel, in some instances, is capable of analyzing signals received from detectors to ascertain the presence of a fire condition. In other systems, a fire determination is made at the respective detectors and a signal indicative thereof is fed back to the control panel.

The above-described alarm systems are often used in combination with sprinkler systems. Known sprinkler systems incorporate sprinkler heads which are coupled to sources of fire suppressing liquids, such as water, or non-aqueous chemical suppressants.

The sprinkler heads are usually sealed with metals having relatively low temperature melting points. In response to the presence of heat from a fire, these metals soften and melt and release a fire suppressant.

Waterflow detectors have been used in such distribution systems to provide an indication that one or more of the sprinkler heads is delivering water to a portion of the region being monitored. Such waterflow detectors are disclosed, for example, in U.S. Pat. Nos. 4,782,333 entitled Waterflow Detector having Rapid Switching and 4,791,414 entitled Waterflow Detector. Both of the noted patents are assigned to the assignee hereof and are incorporated by reference herein.

Outputs from the waterflow detectors can in turn be used to directly energize alarm indicating visual or audible loads. Alternately, such signals can be coupled to an alarm system control panel for the purpose of providing additional warnings.

It is known that, from time to time, transient movement of water in a distribution system can occur in response to non-fire conditions. Such transient movement can be caused, by example, by intra-system water surges due to various causes.

Known water flow sensors often incorporate mechanical timers to incorporate a delay in an attempt to suppress such transience thereby minimizing false alarming. Known timers suffer from variability of the delays that are provided due to the mechanical timing mechanisms.

It would be desirable to provide highly repeatable transient suppressing delay intervals for use with waterflow sensors. Preferably such repeatable delay intervals could be achieved without introducing additional manufacturing complexity or manufacturing costs. It would also be desirable to be able to minimize power dissipation during no flow conditions.

SUMMARY OF THE INVENTION

A fluid flow detection unit incorporates a flow sensor which is coupled to a flow indicating switch having an open circuit state and a closed circuit state. A second switch having an open circuit state and a closed circuit state is also provided. The flow indicating switch and the second switch are both coupled to an electronic timer.

When the flow indicating switch exhibits a state indicative of the presence of flow, the electronic timer is enabled. When the timer generates an output, after a pre-set delay and if the flow indicating switch is still indicating fluid flow, then non-transient fluid flow is probably present. The delayed output from the timer can be used to close the second switch. In response to the two switches having changed state, energy can be provided to a load.

In one aspect of the invention, energy can be provided to an audible or a visual alarm indicating device. Alternately, or in addition, an alarm indicating signal can be provided to a control panel for an alarm system monitoring the region of interest.

In another aspect, the flow indicating switch can be coupled in series with the delay switch. In response to the flow indicating switch assuming a closed state, indicative of the presence of flow, a timer can be enabled.

Once the timer circuit times out, after its preset delay interval, and assuming that the flow indicating switch is still exhibiting a closed circuit state, the delay switch can be closed enabling a transfer of electrical energy from an input terminal, associated with the flow indicating switch, to an output terminal, associated with the delay switch. The electrical energy can in turn be transferred to a local alarm indicating unit and/or an associated alarm system.

In yet another aspect, each time the flow indicating switch goes from a closed, flow indicating state, to an open, no flow state, the timer circuitry can be reset. Further, the delay switch can be implemented as a latching switch which will continue to exhibit a low impedance state for as long as the flow switch indicates the presence of flow in the associated conduit. Finally, when in the no flow state, the timer circuit can be forced into a minimal power quiescent state.

When used with an alarm system, the flow indicating circuitry can be coupled to a power supply operable under the control of the alarm system control panel. The control panel can in turn switch the power supply from an inactive to active state.

Switching the power supply to an active state in turn energizes the switches associated with each of the flow sensors and simultaneously resets each of the latch-type, delay, switch to an open circuit state. Hence, subsequent to the fire condition having brought under control, the panel can de-energize and re-energize the waterflow detection circuitry thereby resetting each of the respective latching switches thereby open-circuiting each such circuit.

The flow indicating switches can be implemented as mechanical switches or as solid state switches without limitation. The latching, delay switches can be implemented as mechanical latching switches such as reed relays or latching relays without limitation. The timer circuitry can be implemented with solid state counters which can be preset to provide an output after a predetermined number of input pulses thereby producing a predetermined delay interval.

Numerous other advantages and features of the present invention will become readily apparent from the following detailed description of the invention and the embodiments thereof, from the claims and from the accompanying drawings.

DETAILED DESCRIPTION OF THE PREFERRED EMBODIMENTS

Figure 1:
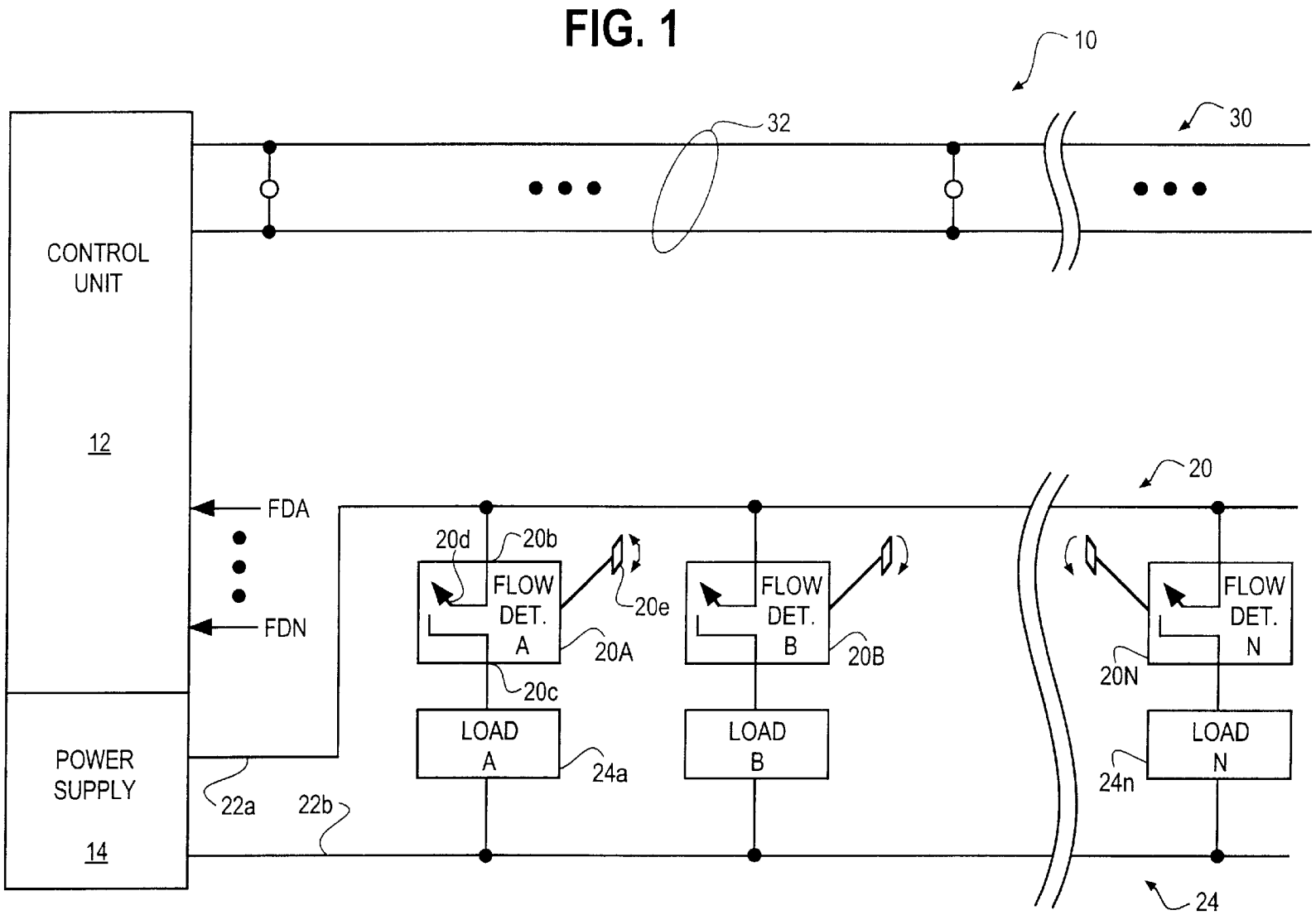
FIG. 1 is a block diagram of an alarm system in accordance with the present invention.

While this invention is susceptible of embodiment in many different forms, there are shown in the drawing and will be described herein in detail specific embodiments thereof with the understanding that the present disclosure is to be considered as an exemplification of the principles of the invention and is not intended to limit the invention to the specific embodiments illustrated.

FIG. 1 illustrates a system 10 which embodies the present invention. The system 10 includes a control unit 12 which could be implemented at least in part with a programmable processor. In such an instance, control programs would be stored in the unit 12 for execution by the processor.

The control unit 12 includes a switchable power supply 14. The switchable power supply can be turned on and off in accordance with the instructions from the control unit 12. The supply 14 can provide AC at its output terminals.

A plurality of fluid flow detectors 20 is coupled via lines 22*a*, 22*b* to the power supply 14. Associated with the plurality 20 is a plurality of corresponding loads 24.

Those with skill in the art will understand that the plurality of loads 24 could correspond to separate audible or visible alarm indicating devices. Alternately, the numbers of the plurality 24 could be combined together in a single audible or visible alarm indicating device. Finally, it will be understood that where one or more members of the plurality 24 are associated with one or more of the plurality 20, that separate load activating signals FDA . . . FDN can be provided to control unit 12 for purposes of supervising the operation of the respective numbers of the pluralities 20, 24.

Each of the members of the plurality 20, for example as illustrated by member 20A, includes first and second power terminals 20*b*, 20*c*. Further, each of the members of the plurality 20 includes a shorting switch, indicated for example as the switch 20*d*.

Each of the flow detectors, includes a flow sensor, for example indicated as sensor 20*e*. The respective flow sensors can be located in or adjacent to pipes or conduits which contain fire suppressing fluids such as, for example, water. Various types of flow sensors can be used without departing from the spirit and scope of the present invention.

The above noted patents, incorporated herein by reference, teach various types of flow sensors. Those of skill in the art will understand that elements, rotatable by a flowing liquid, can be used to provide switch closing (or opening) mechanical motion. Electronic or pressure indicating sensors can also be used to detect flow without departing from the spirit and scope of the present invention.

In response to the presence of heat or flame of a sufficient temperature, one or more of the sprinkler heads can be activated causing a flow of fluid in a respective pipe or conduit. If a valve is opened, a flow of fluid will result. The flow is detected by the flow sensors, such as the sensor 20*e*, of the detector 20A.

In response to non-transient flow, the switch 20*d* is closed thereby short circuiting terminals 20*b*, 20*c*. This provides maximum available energy to the respective load member of the plurality 24.

The switch 20*d* will be retained in its closed circuit state so long as the flow indicating sensor, 20*e*, provides an appropriate indicator of on-going flow. In such an instance, the corresponding load, such as the load 24*a*, will be energized and provide an audible or visible alarm.

Alternately, or in addition, a corresponding signal FDA can be provided to control unit 12 indicative of detected flow from the unit 20*a*. In such an instance, the control unit 12 can be enabled to provide one or more additional alarms if desired.

The control unit 12 can also be used with a plurality of non-flow, ambient condition detectors 30. Typical detectors include smoke, heat, or flame detectors. The members of the plurality 30 can communicate with the control unit 12 by means of a communication link 32.

Figure 2:
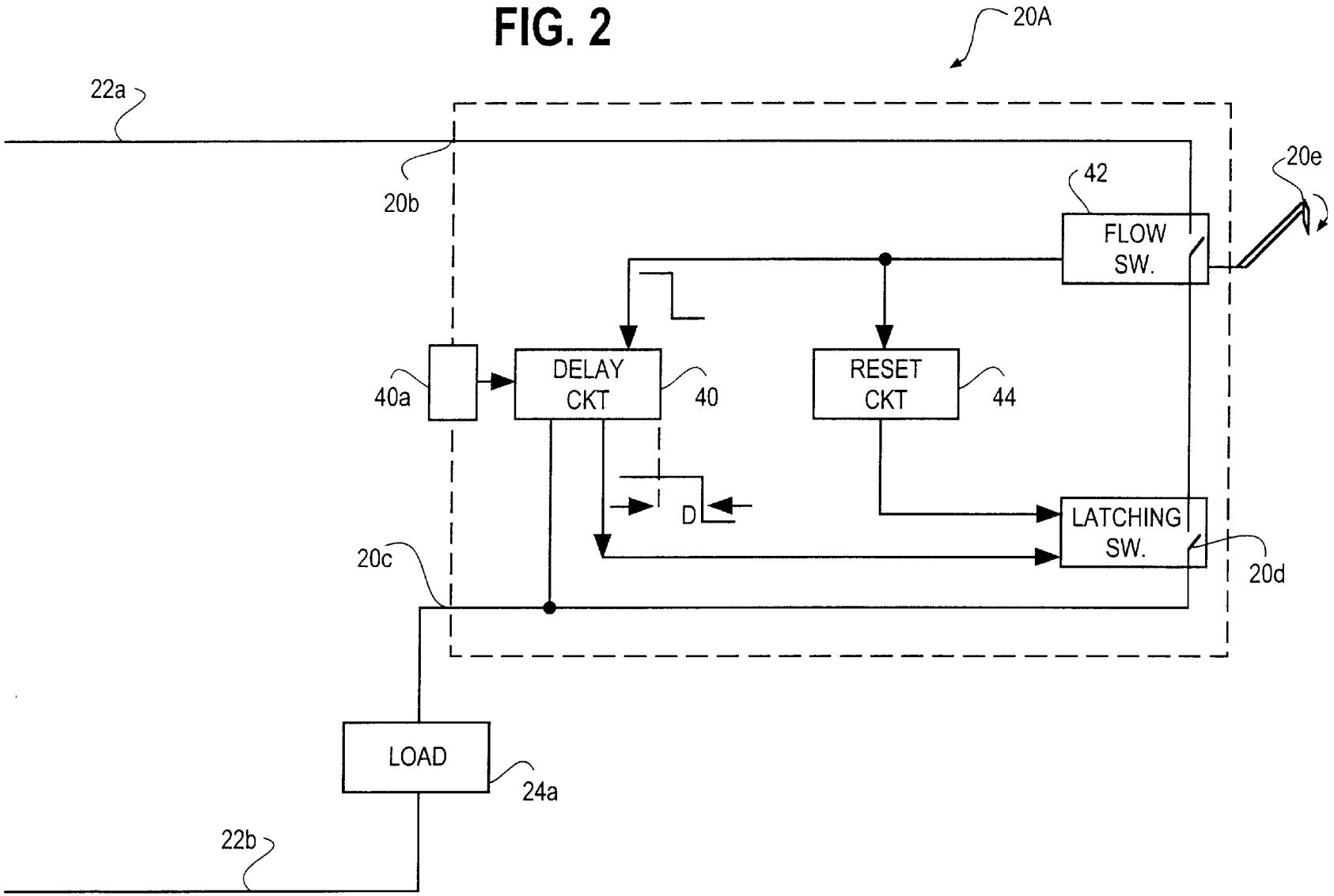
FIG. 2 is an over-all block diagram of a flow detector usable in the system of FIG. 1.

FIG. 2 illustrates more details of representative flow detector 20A. Only flow detector 20A needs to be discussed as the others, 20B–20N are substantially identical. The representative detector 20A includes a solid state delay circuit 40. In addition, the detector 20A includes a main flow indicating switch 42 coupled to a flow sensor, such as the flow sensor 20*e*.

In response to the flow sensor 20*e* (which could be a non-contact flow or pressure sensor) sensing the presence of flow in an associated fluid, the switch 42 will change state, for example going from an open to a closed state. The switch 42 will remain closed so long as fluid flow continues to be sensed by the sensor 20*e*. In the event that flow ceases, the sensor 20*e* will indicate an absence of flow thereupon permitting switch 42 to assume a no flow, open circuit, state.

Switch 42 is coupled in series with switch 20*d* discussed previously. When both switch 42 and switch 20*d* are closed, a short circuit exists between terminals 20*b*, 20*c*. In this condition, electrical energy applied to terminal 20*b* is transferred directly to a respective external load 24*a* which could be an audible (horn, bell, gong, etc.) or visible (strobe light) alarm device.

The switch 20*d* is preferably implemented as a mechanical latching switch. The switches 42 and 20*d*, when closed, provide very low impedance mechanical electrical paths between the terminals 20*b, c*, thereby reducing energy losses in the detector 20*a* and providing maximal energy to the respective load.

The detector 20A also includes reset circuitry which could be implemented, as a monostable multivibrator or one-shot 44. When the control unit 12 energizes the power supply 14, and electrical energy is delivered to the members of the plurality such as the detector 20A, the reset circuitry 44 generates electrical signals, for example a single pulse, for the purpose of open-circuiting the latch 20*d*.

In the reset state, the delay circuit 40 is always energized by electrical energy supplied between terminals 20*b, c*. In this condition, the delay circuitry is preferably forced into a low power consuming quiescent state.

In response to sensor 20*e* detecting fluid flow, main flow switch 42 closes thereupon triggering the operation of delay circuitry 40. Delay circuitry 40 could be implemented for example, as a programmable timer which can be counted down (or up) when enabled. Alternately a programmed processor could be used to implement a delay interval.

When the delay circuitry 40 counts down from its preset state, or up from its preset state depending on the selected hardware configuration, an output signal delayed in time D sec. is generated. This signal, indicated as a downgoing signal in FIG. 2, is in turn used to close latching switch 20*d*. A short circuit is now being imposed now terminals 20*b, c*. Energy will be continuously to load 24*a* so long as flow switch 42 stays closed (flow continues), latching switch stays closed, and power is not removed from the system.

It will be understood by those of skill in the art that each time main flow switch 42 changes state, closes for example, indicate flow, delay circuit 40 will be enabled and the delay interval is initiated. Each time main flow switch 42 indicates a cessation of flow, opens for example, delay circuit 40 is reset. Resetting delay circuit 40 in turn resets latching switch 20*d* in the event that that switch has been closed.

The members of the plurality 20, as exemplified by the flow detector 20A of FIG. 2 utilize very little electrical energy in the no flow state. In a closed circuit state, assuming also the latch switch 20*d* has been closed, there is only a minimal increase in power dissipated in the unit 20A beyond that which is dissipated in its quiescent state due to the fact that switches 42 and 20*d* provide a short circuit between terminals 20*b, c*.

Each time flow switch 42 exhibits a no flow, open circuit state, it resets delay circuitry 40 which in turn resets switch 20*d*. A plurality of manually settable programming switches 40*a* is provided, coupled to delay circuit 40, for purposes of establishing the delay interval D.

It will be understood that alternate configurations of switches 42 and 20*d* could be implemented without departing from the spirit and scope of the present invention. Switches 42 and 20*d* could be implemented with various types of mechanical or solid state switches which exhibit a relatively low electrical impedance in a selected, closed, state. Switches 42, 20*d* can be wired in series or parallel without departing from the spirit and scope of the present invention.

Figure 3:
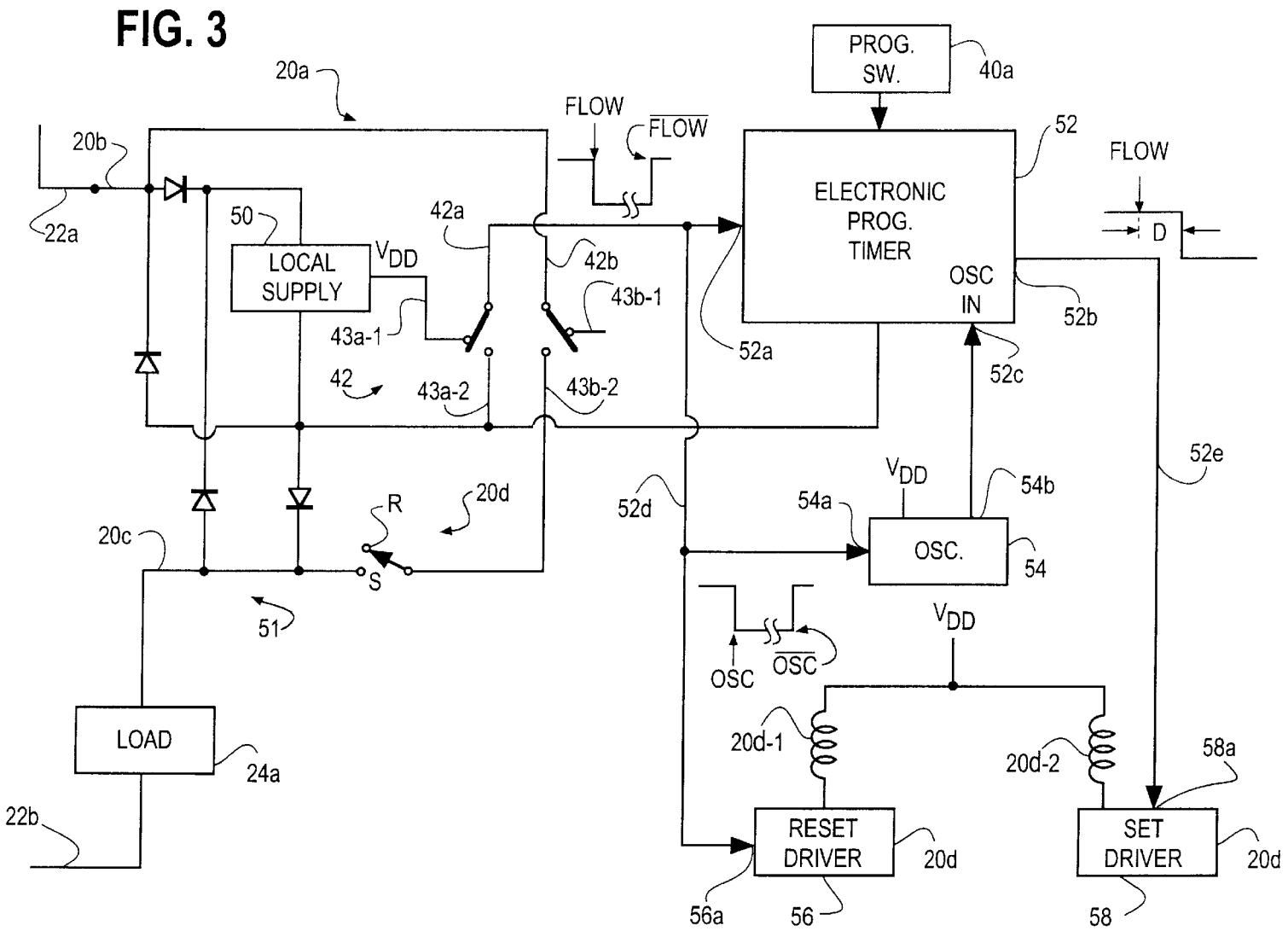
FIG. 3 is a more detailed, schematic diagram of the flow sensor of FIG. 2.

FIG. 3 illustrates the detector 20A in more detail. The detector 20A includes a local power supply 50 for providing a local source of electrical energy. The supply 50 is fed by a full wave bridge rectifier indicated at 51. The delay circuit 40 can include a programmable electronic timer 52 with a reset input 52*a* and a delayed output, depending on the setting of the program switches 40*a*, at output port 52*b*. Timer 52 can be driven by a pulse source applied at input port 52*c*.

The main flow switch 42 can be implemented, for example, as a Form C, double pole double throw switch having poles 42*a, b*. Each of the poles 42*a, b* has an associated normally closed contact 43*a*–1 43*b*–1 and a normally open contact 43*a*–2, 43*b*–2.

FIG. 3 illustrates switch 42 in a no flow state. In this condition, a voltage, generated by supply 50, is coupled via pole 42*a* to reset input 52*a* of timer 52 thereby causing the timer 52 to remain in an inactive, reset, state. The reset signal, input port 52*a*, is also coupled via a line 52*d* to an oscillator 54 with a control input port 54*a* and an output port 54*b*.

As illustrated in FIG. 3, in a no flow condition, a relatively high signal is coupled via the line 52*d* to the input control port 54*a* of oscillator 54 thereby holding the oscillator in a relatively low power, non-oscillating, quiescent state. The line 52*d* is also coupled to an input port 56*a* of reset driver circuitry 56.

Reset driver circuitry 56 is coupled to a reset coil 20*d*–1 of latching switch 20*d*. Reset drive circuitry 56 will energize coil 20*d*–1, thereby resetting latching relay 20*d*, in response to a signal on the line 52*d* going from a low, flow indicating state to a relatively high, no flow, state.

The delay signal output port 52*b* of timer 52, is coupled via a line 52*e* to set driver circuitry 58 which has an input port 58*a*. Set driver circuitry 58 is in turn coupled to a set or closure coil 20*d*–2 of the latching switch 20*d*. Set driver circuitry 58, in response, for example to a delayed, down going signal, energizes the set relay coil 20*d*–2 thereby causing relay 20*d* to close or assume a "set" state.

When electrical energy is initially applied to the members of the plurality 20, by switching on the power supply 14, as illustrated in FIG. 3, the flow detectors will receive electrical energy via a respective input terminal, such as terminal 20*b*. Assuming a no flow condition, a high signal will be applied to the reset input port of timer 52 forcing it into a reset state. The same high signal will be applied to the input port 56*a* of reset driver circuitry 56 thereby open circuiting latching switch 20*d*, and, via a respective input terminal, such as control port 54*a* forcing oscillator 54 into its non-oscillatory quiescent state. In this condition, no electrical energy is coupled between the terminals 20*b, c*.

In the presence of flow in the respective conduit, sensor 20*e* will in turn cause the flow switch 42 to change state thereupon placing a relatively low voltage at the reset input port 52*a* of the timer 52, at the input port to drive circuitry 56 and at the input port of oscillator 54. This will in turn permit oscillator 54 to generate a plurality of pulses at its output port 54*b*. These pulses are in turn coupled, via line 54*c*, to oscillator input port 52*c* of timer 52. The string of input pulses causes the timer 52 to count up or down from its preset state, dictated by the switches 40*a*.

After a delay interval D, a down going pulse is generated at output port 52*b* and coupled by line 52*e* to input port 58*a* of drive circuitry 58. This in turn energizes the coil 20*d*–2 causing relay 20*d*, which could be implemented as a latching relay, to set or change state. In this condition, with switch 42 indicating a flow condition and latching relay 20*d* in a set state, electrical energy will be provided by a short-circuited path between terminals 20*b, c* to respective load 24*a*. Energy will continue to be provided in this fashion until flow ceases or until power supply 14 is turned off. In this instance, time 52 is reset, latching relay 20*d* is reset and oscillator 54 is disabled thereby forcing the detector 20A into a very low power quiescent state.

It will be understood that switches 42 and 20*d* could be implemented with solid state devices without departing from the spirit and scope of the present invention. Timer 52, oscillator 54, and coil drive circuits 56, 58 could similarly be implemented with a variety of circuits without departing from the spirit and scope hereof. A typical delay interval D might be on the order of 0–90 seconds.

In FIG. 3, load current which passes through switch 20*d* does not flow through flow sensing contacts 42*a*, 43*a*–2. The load current bypasses local supply 50. It will be understood that switches 42 and 20*d*, when in a closed or conducting state permit a flow of current therethrough, or can couple a voltage thereacross.

Figure 4:
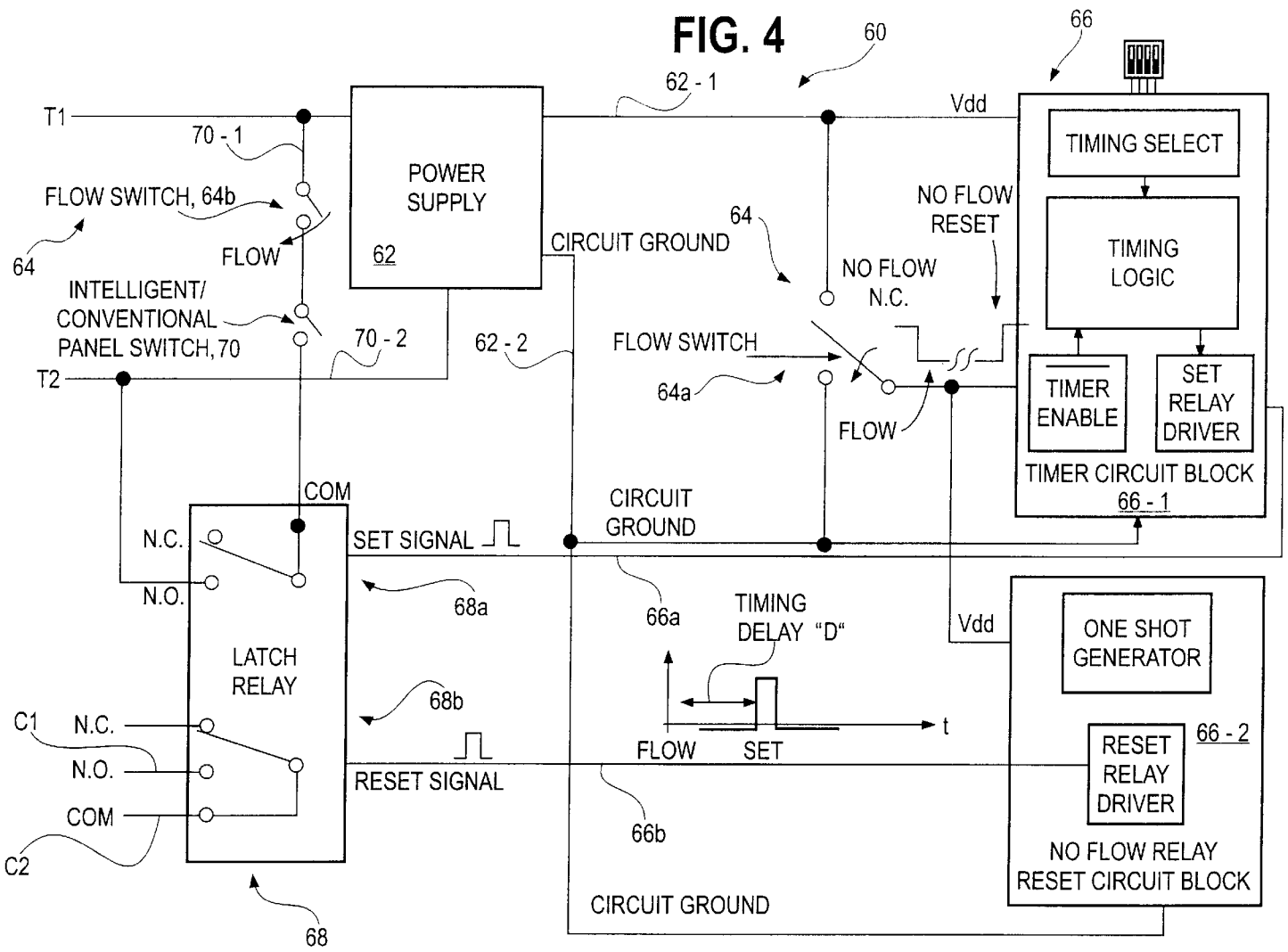
FIG. 4 is a block diagram of another embodiment of a detector in accordance with the present invention.

FIG. 4 illustrates a block diagram of a multi-mode flow detection system in accordance with the present invention. The system 60 includes a power supply 62 having outputs on lines 62-1, 62-2. A double pole-double throw flow indicating switch 64 is indicated generally at pole 64*a* and pole 64*b*. If desired, two separate switches could be used.

The system 60 also includes timer and control electronics 66. It will be understood that the timer and control electronics, element 66, could be implemented using a programmed processor with executable instructions stored in a read only or programmable read only memory. Alternately, the element 66 could be implemented with a digital timer of a known variety.

Outputs from the timer and control electronics 66 include a set signal intermittently present on a line 66*a*. A reset signal is intermittently present on a line 66*b*.

The system 60 also includes a double pole double throw latching relay 68 having poles 68*a* and 68*b*. Latching relay 68 includes a set input port and a reset input port to which wires 66*a* and 66*b* are coupled.

A jumper or single pole-single throw switch 70 is located in a line 70-1 which is in turn coupled to an input terminal T1. A second line 70-2 is coupled between the other side of the power supply 62 and a second terminal T2.

Switch 64 is in turn coupled to a flow indicator, such as indicator 20*e*, see FIG. 2. Switch 64 exhibits a quiescent, no-flow state as illustrated in FIG. 4. Pole 64*a* exhibits a closed circuit to line 62-1 in a no-flow state. Pole 64*b* exhibits an open circuit state relative to line 70-1 in the no-flow state.

When power is applied to the terminals T1, T2, power supply 62 becomes energized and applies voltage across lines 62-1 and 62-2 which in turn energizes the timer and control electronics 66. In response thereto, the timer and control electronics 66 generates an initial reset pulse on the line 66*b* after a delay. This delay could for example be on the order of 3 seconds long.

On the assumption that the jumper or switch 70 is closed, pole 64*b* is energized by voltage applied at the terminal T1. However, terminals T1 and T2 are isolated from one another in view of the fact that pole 64*b* is in a no-flow, open circuit state.

In the presence of flow in an associated conduit, perhaps indicated by element 20*e*, switch 64 changes state. This in turn causes poles 64*a* and 64*b* to go from a no-flow state to a flow state. A low voltage is applied as an input to timer/control electronics 66. This transition triggers a delay interval D.

At the end of the delay interval D, the timer/control electronics 66, assuming that the flow switch 64 continues to exhibit a flow state, generates a set pulse on the line 66*a*. The set pulse is in turn coupled to latching relay 68 causing poles 68*a* and 68*b* to change state and remain latched in that state. In this condition, terminal T1 is electrically shorted to terminal T2 through switch 70 and poles 64*b*, 68*a*. This in turn disables supply 62 and circuit 60.

When there is a cessation of flow, the switch 64 returns to its no-flow state. This removes the short from terminals T1 and T2. Assuming due to a manual reset or the like, that voltage is again applied across terminals T1, T2, power supply 64 will again be energized and a voltage will again applied via pole 64*a* to the input to timer and control electronics 66. This power-up condition in turn generates a reset pulse on the line 66*b*. This in turn causes the latching relay 68 to return to its original, no-flow state.

As is illustrated in the above description, the state of the element 70, which could be a single pole-single throw switch or a jumper for example, determines whether terminals T1 and T2 are electrically shorted together in the presence of flow. The presence of double pole-double throw latching relay 68 and the switching element 70 makes it possible to configure system 16 for use in various types of installations.

Figure 5:
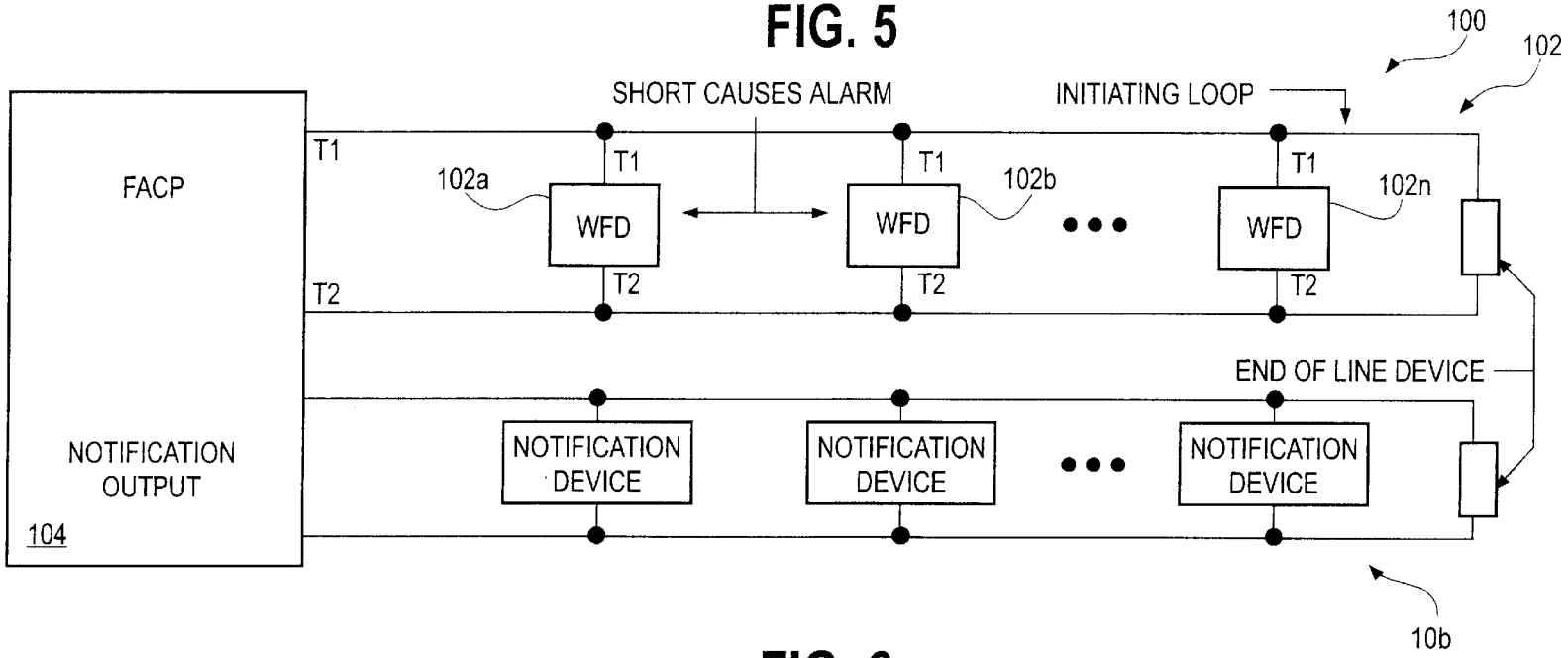
FIG. 5 is a block diagram of a first system in which the detector of FIG. 4 can be used.

FIG. 5 is a block diagram of an alarm system 100 which incorporates a plurality of circuits 102*a*, 102*b* . . . 102*n* that are substantially identical to the system 60. These circuits are connected into a detection loop 102.

The system 100 also includes a known form of a fire alarm control panel 104. Associated with the panel 104 is a notification loop 106 which can include both audible and visible alarm devices. As is known, for certain types of alarm systems, the control panel 104 regards a shorted condition between terminals T1, T2 as an indication that the detecting loop 102 is signaling the presence of an alarm condition. In this instance, the control panel 104 responds by energizing the notification loop 106 to produce audible and visible alarm indications.

As noted above, the flow detectors 102*a* . . . 102*n* can be implemented using the system 60. In this installation in each instance the switching element 70 will be closed or short circuited. When in this state, each of the waterflow detectors 102*a* . . . 102*n* will place a short circuit across terminals T1, T2 in the presence of detected flow after the delay interval D.

Figure 6:
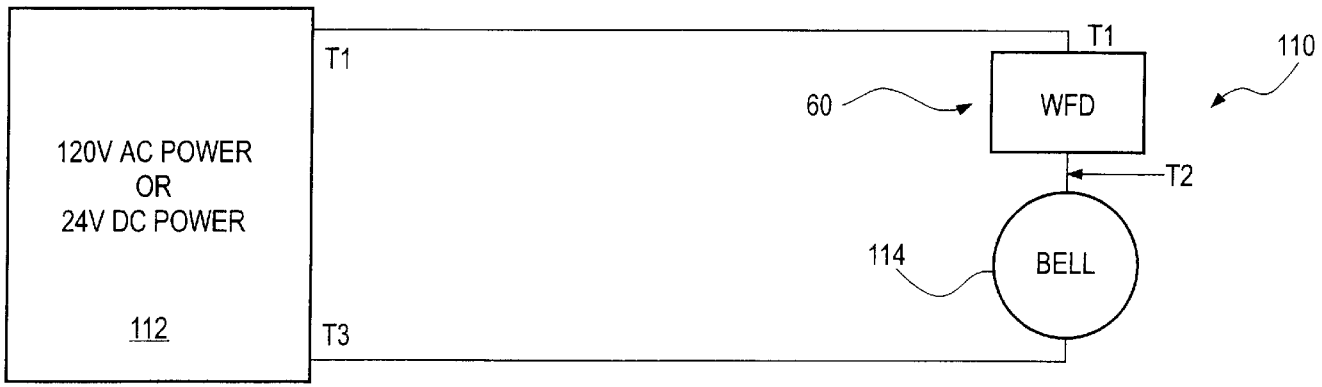
FIG. 6 is a block diagram of a second system in which the detector of FIG. 4 can be used.

FIG. 6 illustrates another application of the flow detection system 60. In the application of FIG. 6, a system 110 includes a power supply 112 which might be switchable and under the control of another system such as an alarm or a detection system.

In the system 110, the waterflow detector 60 is in turn directly coupled between terminal T1 which extends to an output terminal of the supply 112 and terminal T2 which is coupled to an output device 114 which could be a visible output device such as a strobe or an audible output device such as a gong or a bell. The output device 114 is in turn coupled to a return terminal of the supply 112.

In this configuration, again assuming switching element 70 is closed in flow detector 60, electrical energy from supply 112 will be coupled to the load 114 via flow detection system 60. The flow detection system 60 is particularly advantageous in the installation of FIG. 6 in that the flow switch 64 and latching relay 68 provide very low impedance contacts between terminals T1 and T2 thereby applying maximum energy to the load 114.

Figure 7:
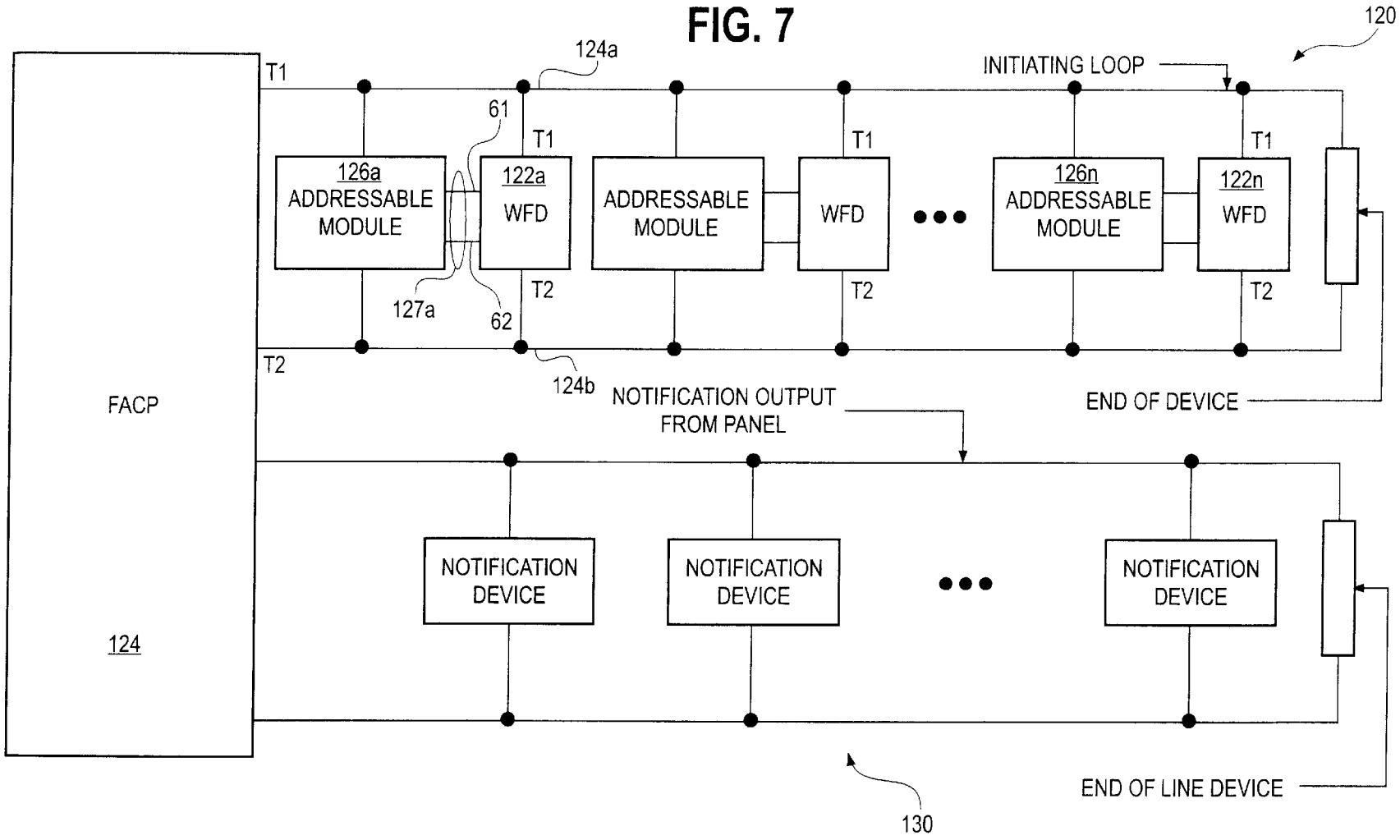
FIG. 7 is a block diagram of a third system in which the detector of FIG. 4 can be used.

FIG. 7 illustrates yet another system 120 wherein the waterflow detection system 60 can be used. In the installation of FIG. 7, each of the detection systems, indicated at 122 *a*. . . 122*n* is configured so that the switching element 70 is in its open circuit position. In this configuration, each of the flow detection units 122*a* . . . 122*n* can be used in a system 120 with a control element 124 which carries on by bidirectional communication via communication lines 124*a*, 124*b*.

The lines 124*a, b* form a detection loop 124 to which other devices, such as fire or gas detectors could be coupled. Such systems, one of which is disclosed and described in U.S. Pat. No. 4,916,432, Tice et al entitled "Smoke and Fire Detection System Communication" and incorporated herein by reference, unlike the system 102, will short circuit the lines 124*a*, 124*b* at most intermittently, if at all, in accordance with the system's transmission protocol. The waterflow detector 60 can be advantageously used in detection loop, 124, which might also incorporate a plurality of ambient condition detectors such as smoke or gas detectors.

Where the system 60 is used in the modules 122*a* . . . 122*n* in response to the detected presence of fluid flow, the respective latching relay 68 receives a set pulse on the line 66*a* which in turn causes that relay to be set wherein poles 68*b* will be short output contacts C1, C2.

With reference to FIG. 7, the contacts C1, C2 can be coupled to a respective addressable module 126*a*. The module 126*a* is in turn coupled to communication links 124*a*, 124*b*. Upon detection of a short circuit via contacts C1, C2 on lines 127*a*, module 126*a* can in turn transmit an appropriate message to control element 124 signaling the presence of detected flow.

The module 126*a* could be used with a variety of devices which produce switch closures for contact closures such door indicating switches, temperature indicators or the like. The module 126*a* in turn converts these switch closures to transmittable messages understandable by the control element 124. The element 124 can in turn energize one or more of the members of a notification loop 130. The members of the loop 130 can include audible and visible output devices such as strobes, horns, alarms, audible annunciators and the like.

Thus, the detection system 60 not only provides for low impedance paths between its terminals, indicative of fluid flow but due to its flexibility and general characteristics, can be incorporated into a variety of alarm system architectures.

In FIG. 4, the timer/control electronics 66 is illustrated as including delay circuitry 66-1 and reset circuitry 66-2. In connection with the reset circuitry 66-2, each time power is applied terminals T1, T2, reset circuitry 66-2, after a delay, on the order of three seconds or so, generates a reset signal on the line 66*b* to reset latching relay 68.

The delay circuitry 66-1 can be implemented using either a programmed processor and associated executable instructions or could be a hardwired circuit which incorporates a programmable, integrated circuit digital timer.

In response to the pole 64*a* moving to an alarm state, due to the presence of fluid flow, a down going signal is coupled to both the delay circuitry 66-1 and the reset circuitry 66-2. The circuitry 66-1 then times out after a time interval D and in turn generates a set pulse on the line 66*a*. The set pulse in turn sets the latching relay 68 which causes poles 68*a* and 68*b* to change state.

It will be understood that reset circuitry 66-2 could be implemented using a variety of circuits including monostable multi-vibrators to provide a delay, on the order of three seconds, if desired. Latching relay 68 and poles 68*a, b* could be implemented as a latching mechanical switch or a latching solid state switch without limitation.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed:

1. A multi-mode flow detection system comprising:

first and second power supplying terminals;

a first switching element with first and second states responsive to fluid flow to go from the first, no flow state, to the second, flow state;

a second, manually settable, switching element having third and forth sates connected in series with at least a portion of the first switching element;

a third switching element having fifth and sixth states, wherein a portion of the third element is coupled to one side of the second switching element wherein the first switching element is coupled to the other side thereof;

a control element coupled to the first and third switching elements whereby in response to the first switching element going from the first to the second state and remaining there for a pre-determined interval the third switching element goes from the fifth to the sixth state, whereupon a short circuit connects the two terminals, until flow ceases provided that the second switching element exhibits the third state.

2. A system as in claim 1 wherein the control element incorporates a digital circuit which establishes the predetermined time interval.

3. A system as in claim 1 wherein despite the third switching element going from the fifth to the sixth states, where the second switching element exhibits the fourth state, the two terminals exhibit a non-short circuit condition.

4. A system as in claim 3 wherein the third switching element includes an isolated, switchable, signal path and wherein that path exhibits a short circuit when the third switching element is in the sixth state.

5. A system as in claim 1 wherein the first switching element includes a double pole switch coupled in part between one terminal and the second switching element.

6. A system as in claim 1 wherein the third switching element includes a latching switch.

7. A system as in claim 6 wherein the control element includes first and second outputs wherein the outputs are coupled to the latching switch.

8. A system as in claim 7 wherein the control element generates a signal on one output to place the latching switch into one state and generates a different signal on another output to place the latching switch into a second, different state.

9. A system as in claim 6 wherein the control element includes a digital timer for establishing the predetermined interval.

10. A system as in claim 1 wherein the control element includes a programmed processor for establishing the predetermined interval.

11. A system as in claim 1 wherein the first switching element includes a double pole switch and the third includes a latching relay wherein one pole is coupled between one terminal and the latching relay and wherein another pole is coupled between the one terminal and the control element whereby as the first switching element goes from a no flow to a flow state the control element initiates the predetermined interval whereupon, when the interval terminates, the control element includes circuits for short circuiting the latching relay in response to the first switching element going to a flow state and staying therein for the predetermined interval.

12. A detector comprising:

a sensor of fluid flow;

a first switch having first and second states, coupled to the sensor;

a digital time delay establishing element, coupled to the first switch, wherein the element is activated each time the first switch goes from the first state to the second state in response to flow having been detected by the sensor and wherein the element generates an output after a selected delay, in response thereto;

a second switch having third and fourth states wherein the second switch goes from the third state to the fourth state in response to the output provided that the first switch is still in the second state; and a mode setting switch element coupled in series with the second switch.

13. A detector as in claim 12 wherein the switches are coupled in series and wherein the second and fourth states correspond in each instance to a closed circuit.

14. A detector as in claim 12 wherein the delay establishing element comprises an electronic timer.

15. A detector as in claim 12 wherein in the absence of flow the first switch goes from the second state to the first state and thereupon resets the delay establishing element.

16. A detector as in claim 12 wherein the second switch incorporates a mechanical latch.

17. A detector as in claim 14 wherein the timer comprises a digital, programmable timer circuit.

18. A detector as in claim 16 wherein the second switch is forced to the third, open circuit, state on power up.

19. A detector as in claim 12 which includes a source of pulses coupled to the element.

20. A detector as in claim 19 wherein the element includes a solid state counter.

21. A detector as in claim 12 which includes first and second terminals and wherein when the first switch is in the second state and the second switch is in the fourth state, the terminals are short circuited.

22. A flow detector comprising:

a first switch element wherein the element exhibits at least an open circuit and a closed circuit state;

a multi-state latching switch element coupled in series with a portion of the first switch element;

a second element in series with the latching switch wherein the second element has an open circuit state and a closed circuit state;

a digital element for establishing a delay interval and with an output coupled to the latching element wherein in response to the first element changing state the digital element initiates the delay interval and in response to detecting an interval end, causes the latching element to enter a selected output state, provided, that the latching element will not enter the selected output state if during the delay interval the first element changes state again.

23. A flow detector as in claim 22 which included a flow responsive member coupled to the first element whereby the flow responsive member causes the first element to go from the open circuit state to the short circuit state in response to fluid flow.

24. A flow detector as in claim 22 wherein the first switch element comprises a double pole switch wherein one pole is coupled to at least the latching switch element and another pole is coupled to the digital element.

25. A flow detector as in claim 24 wherein if the first element changes state and initiates the delay interval, and changes state again during the delay interval, the digital element is, at least in part, reset.

26. A flow detector as in claim 24 wherein the latching switch element comprises a double pole, latching relay wherein one pole is coupled to the first switch.

27. A flow detector as in claim 22 wherein the second element is manually settable to a selected mode specifying state.

28. A flow detector as in claim 22 wherein the first switch element comprises at least one solid state switch.

29. A flow detector as in claim 22 wherein the latching switch element comprises at least one solid state switch.

30. A flow detector comprising:

a first switch element wherein the element exhibits at least first state and a second state;

a multi-state latching switch element coupled in series with a portion of the switch element;

a second element in series with the latching switch wherein the second element has a third state and a fourth state;

a digital timing element for establishing a delay interval and with an output coupled to the latching element wherein in response to the first element going from one state to another state the digital element initiates the delay interval and in response to detecting an interval end, causes the latching element to enter a selected state, provided, that the latching element will not enter the selected state, if during the delay interval, the first element again changes state.

31. A detector as in claim 30, wherein in response to applied power, the latching switch element is reset.

32. A detector as in claim 30 wherein in response to the first switch entering a selected state, the timing element is reset.

33. A detector comprising:

a sensor of fluid flow;

a first switch having first and second states, coupled to the sensor, wherein when in the second state, the first switch exhibits a low electrical impedance;

an electronic time interval establishing circuit coupled to the first switch, wherein the circuit is activated to establish a predetermined delay interval each time the first switch goes from the first sate to the second state in response to flow having been detected by the sensor;

a second switch having third and fourth states, wherein when in the fourth state, the second switch exhibits a low electrical impedance, and wherein the second switch goes from the third state to the fourth state in response to an end of the delay interval provided that the first switch is still in the second state; and wherein the second switch is in parallel with at least a portion of the first switch.

34. A detector as in claim 33 wherein the second switch incorporates a mechanical latch.

35. A detector comprising:

a sensor of fluid flow;

a first electrical switch having first and second states, coupled to the sensor, wherein when in the second state, a current can flow through at least part of the first switch;

an electronic timer circuit coupled to the first switch, wherein the timer circuit is activated each time the first switch goes from the first state to the second state in response to flow having been detected by the sensor and wherein the timer circuit generates a selected delay, in response thereto; and a second electrical switch having third and fourth states, wherein when in the fourth state, a different current can flow through the second switch, and wherein the second switch goes from the third state to the fourth state, provided that the first switch is still in the second state after the selected delay.

36. A detector as in claim 35 wherein the timer circuit comprises a programmed processor.

37. A detector as in claim 35 wherein a part of the first switch is series coupled to a part of the second switch.

38. A detector as in claim 35 wherein each of the switches, when in the current flow state, exhibits substantially a short circuit.

39. A detector as in claim 35 wherein each of the switches comprises a closable mechanical contact.

40. A detector as in claim 35 wherein the timer circuit exhibits a minimize power drawing quiescent state when the first switch is in the first state.

41. A detector as in claim 35 wherein the second switch latches in its fourth state.

42. A detector as in claim 37 wherein a short circuit exists across the switches in response to both switches being in the closed state.

43. A system comprising at least one flow detector having a sensor of fluid flow;

a first electrical switch having first and second states, coupled to the sensor, wherein when in the second state, a current can flow through at least part of the first switch;

an electronic timer circuit coupled to the first switch, wherein the timer circuit is activated each time the first switch goes for the first state to the second state in response to flow having been detected by the sensor and wherein the timer circuit generates a selected delay, in response thereto;

a second electrical switch having third and fourth states, wherein when in the fourth state, a current can flow through the second switch, and wherein the second switch goes from the third state to the fourth state, provided that the first switch is still in the second state afier the selected delay; and a third, manually settable mode switch.

44. A system as in claim 43 wherein when in the fourth state, a different current can flow through the second switch.

45. A system as in claim 43 wherein the timer circuit comprises a programmed processor.

46. A system as in clam 43 wherein a part of the first switch is series coupled to a part of the second switch.

47. A system as in claim 43 wherein each of the switches, when in the current flow state, exhibits substantially a short circuit.

48. A detector as in claim 43 wherein each of the switches comprises a closable mechanical contact.

49. A system as in claim 43 wherein the timer circuit exhibits a minimal power drawing quiescent state when the first switch is in the first state.

50. A system as in claim 43 wherein the second switch latches in its fourth state.

51. A system as in claim 46 wherein a short circuit exists across the switches in response to both switches being in the closed state.

52. A system as in claim 44 wherein the second switch comprises a latching relay having at least one pair of isolated, closable contacts wherein a contact closure can provide a flow indicating signal to another electrical unit.

53. A system as in claim 43 comprising:

a control element;

a switchable power supply coupled to the control element; and a plurality of ambient condition detectors from a class which includes smoke detectors, gas detectors, heat detectors, and intrusion detectors.

54. A system as in claim 53 wherein the flow detector includes first and second terminals with one of the terminals coupled to the power supply and with the other couplable to a load wherein the second switch, when in the fourth state, short circuits the terminals.

55. A system as in claim 53 wherein the flow detector in response to energy being applied thereto assumes a minimal power dissipating quiescent state.

56. A system as in claim 53 wherein said at least one flow detector includes a plurality of flow detectors coupled in parallel, wherein when energy is applied to the plurality of flow detectors and the flow detectors are in a quiescent state, the aggregate current flow through the plurality of flow detectors is below a minimum detectable threshold.

* * * * *